US007085394B2

(12) United States Patent
Usuki et al.

(10) Patent No.: US 7,085,394 B2
(45) Date of Patent: Aug. 1, 2006

(54) ELECTRO-ACOUSTIC TRANSDUCER AND ELECTRONIC DEVICE

(75) Inventors: Sawako Usuki, Kobe (JP); Shuji Saiki, Nara Pref. (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 352 days.

(21) Appl. No.: 10/246,764

(22) Filed: Sep. 19, 2002

(65) Prior Publication Data

US 2003/0068063 A1 Apr. 10, 2003

(30) Foreign Application Priority Data

Oct. 9, 2001 (JP) ..... 2001-310914
May 10, 2002 (JP) ..... 2002-135152

(51) Int. Cl.
*H04R 25/00* (2006.01)

(52) U.S. Cl. ..... 381/412; 381/408; 381/431

(58) Field of Classification Search ..... 381/396, 381/400, 399, 190–191, 431, 401, 408, 420–423, 381/417
See application file for complete search history.

(56) References Cited

U.S. PATENT DOCUMENTS 3,012,107 A * 12/1961 Hanlet ..... 381/408
3,141,071 A * 7/1964 Rich ..... 381/408
5,764,784 A * 6/1998 Sato et al. ..... 381/412
5,901,235 A * 5/1999 Thigpen et al. ..... 381/431
5,905,805 A * 5/1999 Hansen ..... 381/398
6,154,557 A * 11/2000 Montour et al. ..... 381/431
6,185,310 B1 * 2/2001 Kermani et al. ..... 381/431
6,404,896 B1 * 6/2002 Yoo et al. ..... 381/401
2002/0061116 A1 * 5/2002 Hara et al. ..... 381/413
2003/0076977 A1 * 4/2003 Levitsky ..... 381/431

FOREIGN PATENT DOCUMENTS

JP 48-24721 A 3/1973
JP 8-140185 A 5/1996
JP 2001-231097 A 8/2001
KR 1984-3571 A 9/1984

* cited by examiner

*Primary Examiner*—Sinh Tran
*Assistant Examiner*—Phylesha Dabney
(74) *Attorney, Agent, or Firm*—Smith Patent Office

(57) ABSTRACT

A first magnet is provided in an upper case and a second magnet is provided in a lower case so that these magnets face each other. These magnets are magnetized in opposite directions. A diaphragm having a drive coil is placed between these magnets. Thus, magnetic flux emitted from the respective magnets bends in a direction approximately perpendicular to the initial direction of emission of the flux. In the magnetic field, the component of the magnetic flux in the direction of radiation proportional to the driving force is dominant, and is symmetrical relative to the direction of vibration. Therefore, the sound pressure of the reproduced sound is increased and the secondary harmonic distortion caused by asymmetry of the driving force can be reduced.

41 Claims, 19 Drawing Sheets

ELECTRO-ACOUSTIC TRANSDUCER AND ELECTRONIC DEVICE

BACKGROUND OF THE INVENTION

1. Field of the Invention

The present invention relates to an electro-acoustic transducer which is mounted to, for example, a cellular phone or a pager, and which is utilized for reproduction of alarm sounds, melody sounds and speech sounds at the time of reception of a call, and also relates to an electronic device such as a cellular phone, a PDA (personal digital assistant), a TV, a personal computer, a car navigation system and the like, wherein such an electro-acoustic transducer is built in.

2. Description of the Related Art

Reduction in the thickness and reduction in the amount of power consumed of electronic device, as represented by cellular phones, PDAs and the like, has been progressing and further reduction in thickness as well as further enhancement in efficiency in electro-acoustic transducers mounted to such electronic device are likewise desirable. Hence, an electro-acoustic transducer, as shown in FIG. 1, has been invented in order to achieve reduction in thickness and enhancement in efficiency (Japanese Unexamined Patent Publication No. H8(1996)-140185).

In this electro-acoustic transducer a casing 20 is formed of a cylindrical cover 1, of which one end is opened, and of a cylindrical frame 2, of which one end is also opened, that are connected to each other. A plurality of small holes 11 are provided in a circular form in the cover 1 for the release of sound. A magnet 3 is secured in a coaxial manner with the cover 1 inside of the cover 1.

A diaphragm 4 in a disk form is placed inside of the casing 20 so as to have a gap G between the diaphragm 4 and the lower surface of the magnet 3, wherein the outer periphery portion of the diaphragm 4 is placed and secured between the cover 1 and the frame 2. A drive coil 5 is secured on the lower surface of the diaphragm 4 so as to be coaxial with the magnet 3. An electrode 6 that allows a current to flow through the drive coil 5 is secured at the bottom surface of the frame 2. A lead wire (not shown) from the drive coil 5 is connected to an edge portion of the electrode 6.

In such an electro-acoustic transducer magnetic flux is emitted from the magnet 3 in a direction approximately perpendicular to the surface of the magnet from the center portion of the magnet so as to penetrate the drive coil 5. On the other hand, the magnetic flux spreads from the surface of the periphery portion of the magnet in a radial form so as to diagonally penetrate the drive coil 5. When a current flows through the drive coil 5 in such a magnetic field, a driving force generates so as to be applied to the drive coil 5 in the direction perpendicular to the diaphragm 4 so that the diaphragm vibrates upwardly and downwardly resulting in the generation of sound. In the case of this electro-acoustic transducer a yoke or a center pole become unnecessary due to the direct emission of magnetic flux from the magnet, thereby the thickness of the transducer can be reduced. In addition, because the winding width of the drive coil 5 can be freely determined, the impedance value can be controlled and, as a result, the amount of power consumption can reduce due to high impedance.

The driving force generating in the drive coil 5, however, is proportional to the magnetic flux perpendicular to the direction of the current flowing through the drive coil 5 and perpendicular to the direction of vibration of the diaphragm 4. Since the magnetic flux parallel to the direction of vibration, rather than the magnetic flux perpendicular to the direction of vibration, is dominant in the conventional electro-acoustic transducer, a sufficient driving force is low and sound pressure of reproduced sound becomes low.

In addition, the magnetic flux emitted from the magnet decreases in proportion to the distance from the magnet. That is, the driving force generating in the drive coil differs between the case where the diaphragm vibrates from the neutral position to the upward direction, that is, in the direction going away from the magnet, and the case where the diaphragm vibrates from the neutral position to the downward direction, that is, in the direction approaching the magnet. There is a problem that this asymmetry causes distortion to the driving force so that the reproduced sound deteriorates.

In addition, in the case of a general electrodynamic type electro-acoustic transducer, a drive coil is inserted into a magnetic gap in a magnetic circuit formed of a magnet, a yoke and a center pole. Therefore, in the case that a drive coil having an unequal form, such as an elliptical or a rectangular form, in comparison with a circular form is inserted into a magnetic gap, the drive coil easily makes contact with the magnetic gap when vibrating. That may cause, in some cases, abnormal sound. Widening of the magnetic gap in order to avoid this phenomenon leads to a reduction in the sound pressure of the reproduced sound. Therefore, there is a limitation to the aspect ratio when the form of such an electrodynamic type electro-acoustic transducer is made elliptical or rectangular.

SUMMARY OF THE INVENTION

An object of the present invention is to realize an electro-acoustic transducer that a driving force generating in a drive coil is increased and is made symmetric relative to the direction of vibration so that the sound pressure of the reproduced sound is increased and so that sound can be reproduced with a low distortion, and electronic device using such an electro-acoustic transducer.

An electro-acoustic transducer of the present invention includes a diaphragm, a housing which supports the diaphragm, a first and second magnets which are placed so as to face each other and to face each surface of the diaphragm so that the diaphragm is placed between the magnets, and which are magnetized in opposite directions to each other and are parallel to the direction of vibration of the diaphragm, and a drive coil which is provided on the diaphragm, wherein the drive coil is provided with so as to include lines connecting the outer peripheries of the first and second magnets.

In addition, an electro-acoustic transducer according to the present invention includes a diaphragm, a housing which supports the diaphragm, a first and second magnets which are placed so as to face each other and to face each surface of the diaphragm so that the diaphragm is placed between the magnets, and which are magnetized in the radial direction having a center axis passing through the center of the diaphragm as the center, and a drive coil which is provided on the diaphragm.

An electronic device of the present invention is electronic device provided with either of these electro-acoustic transducers.

DETAILED DESCRIPTION OF THE PREFERRED EMBODIMENTS

Embodiment 1

Figure 1:
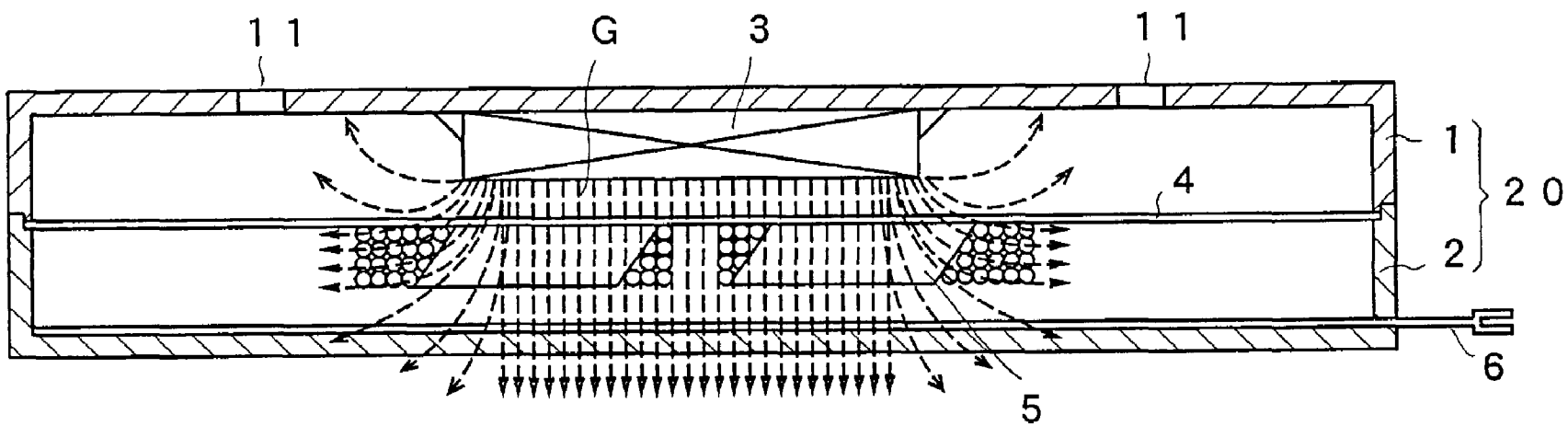
FIG. 1 (PRIOR ART)
FIG. 1 is a cross sectional view of an electro-acoustic transducer according to a prior art.
Figure 2A:
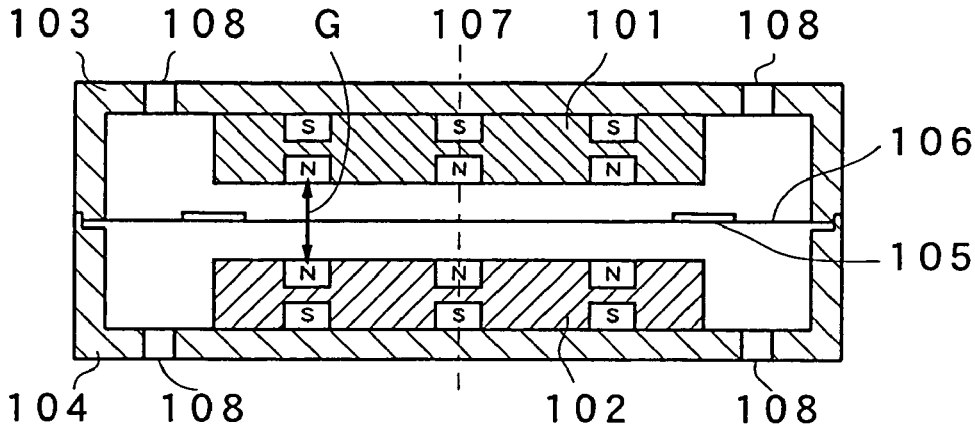
FIG. 2A is a cross sectional view of an electro-acoustic transducer according to Embodiment 1 of the present invention.
Figure 2B:
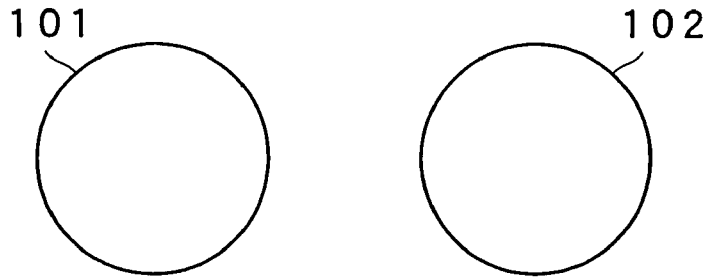
FIG. 2B is a plan view of first and second magnets according to Embodiment 1.
Figure 2C:
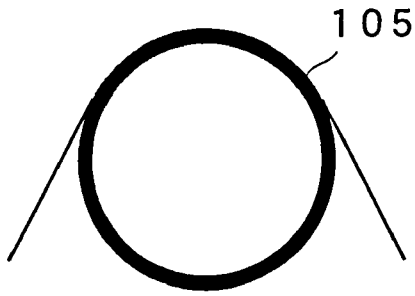
FIG. 2C is a plan view of a drive coil according to Embodiment 1.
Figure 3:
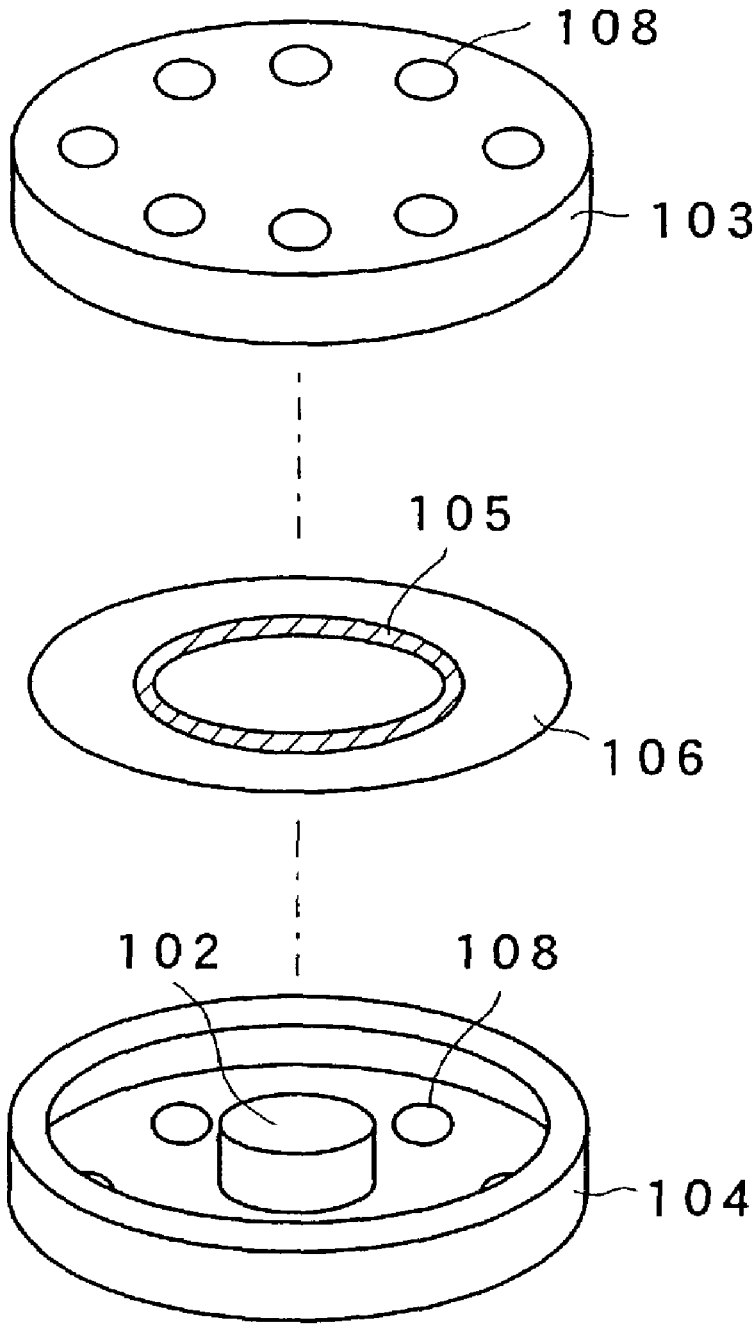
FIG. 3 is an assembly configuration view of an electro-acoustic transducer of Embodiment 1.
Figure 4:
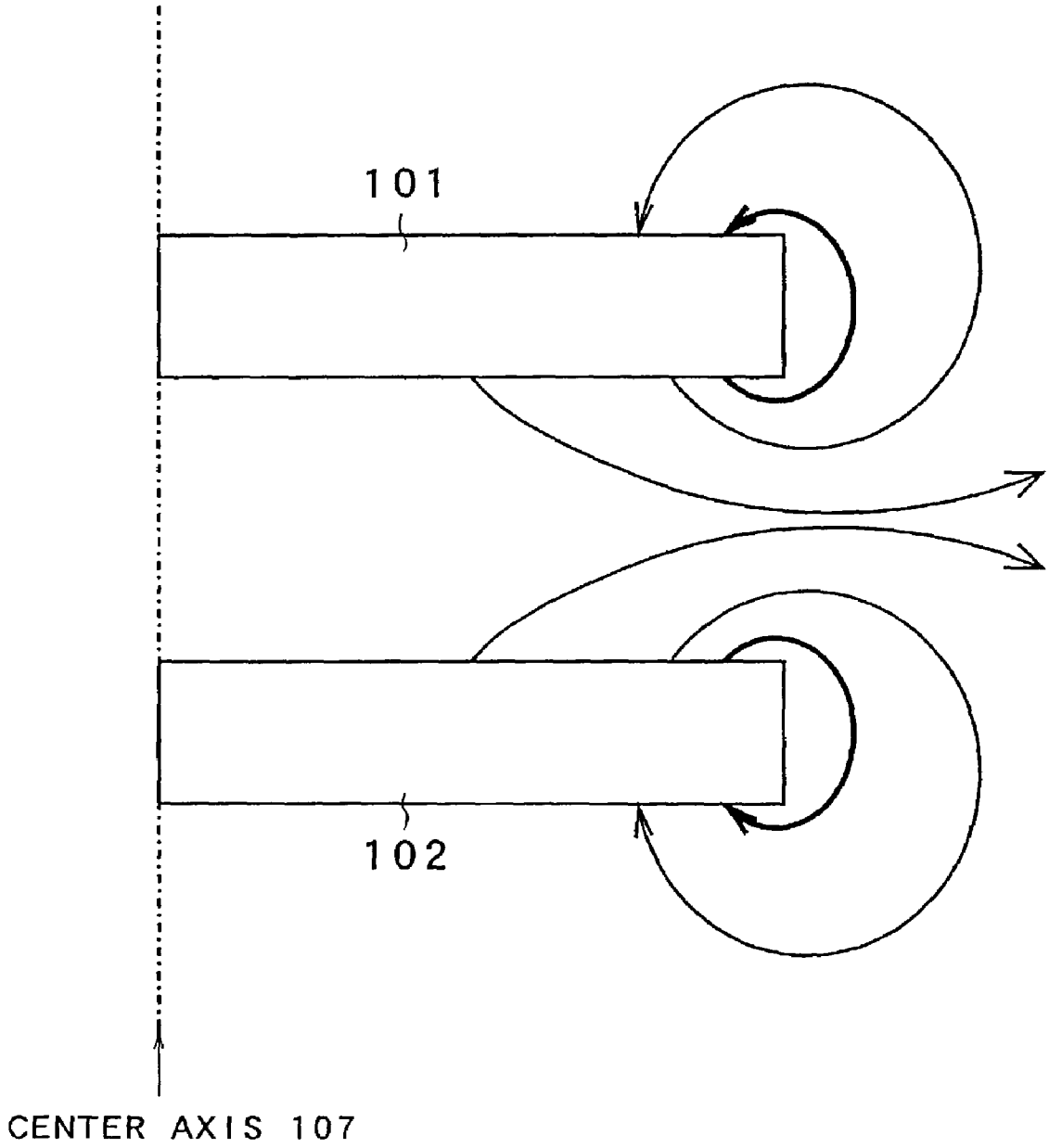
FIG. 4 illustrates magnetic flux vectors generating due to first and second magnets according to Embodiment 1.
Figure 5:
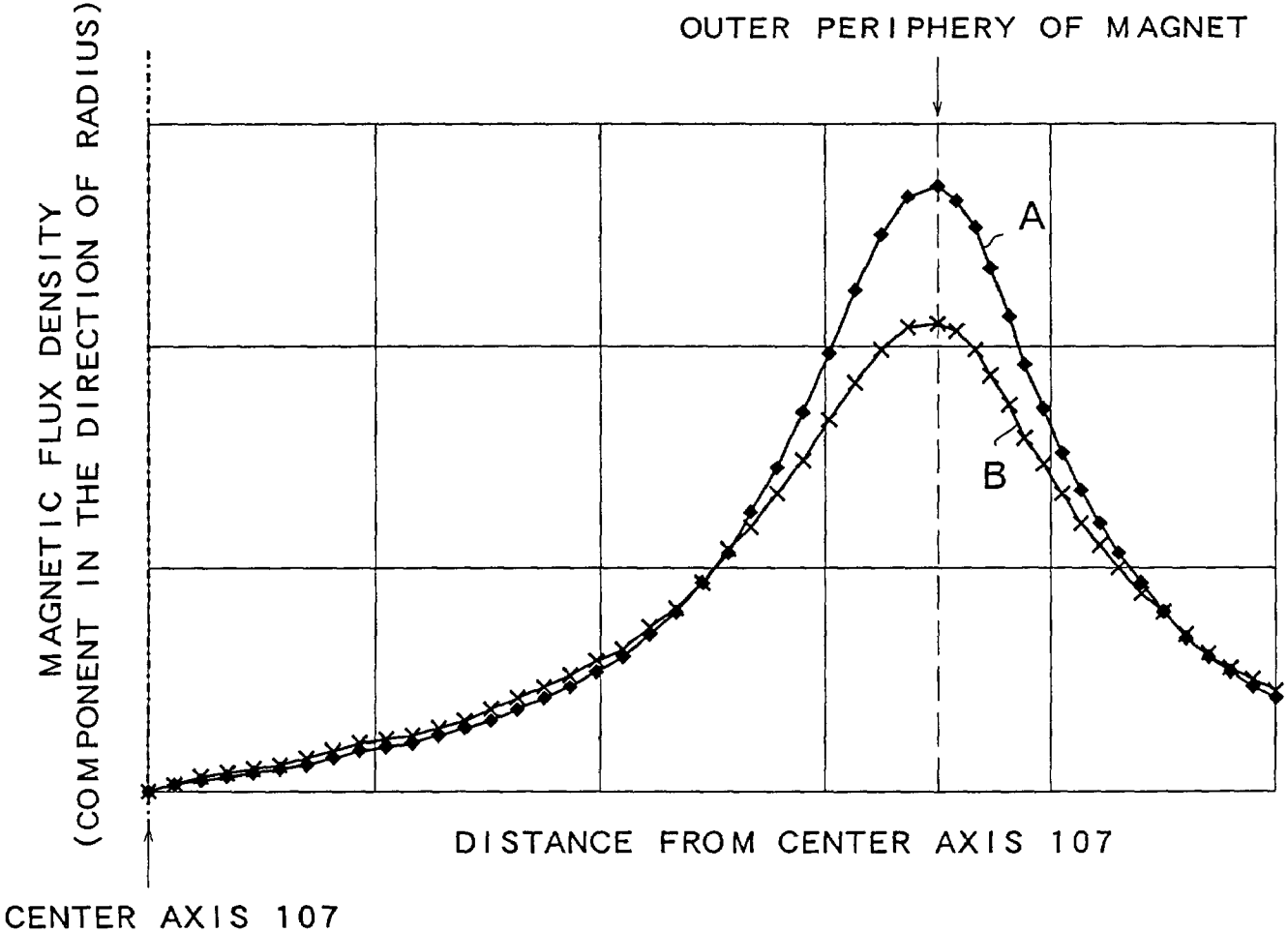
FIG. 5 is a graph showing the relationship between the distance in the radius direction from the center axis and the magnetic flux density according to Embodiment 1.
Figure 6:
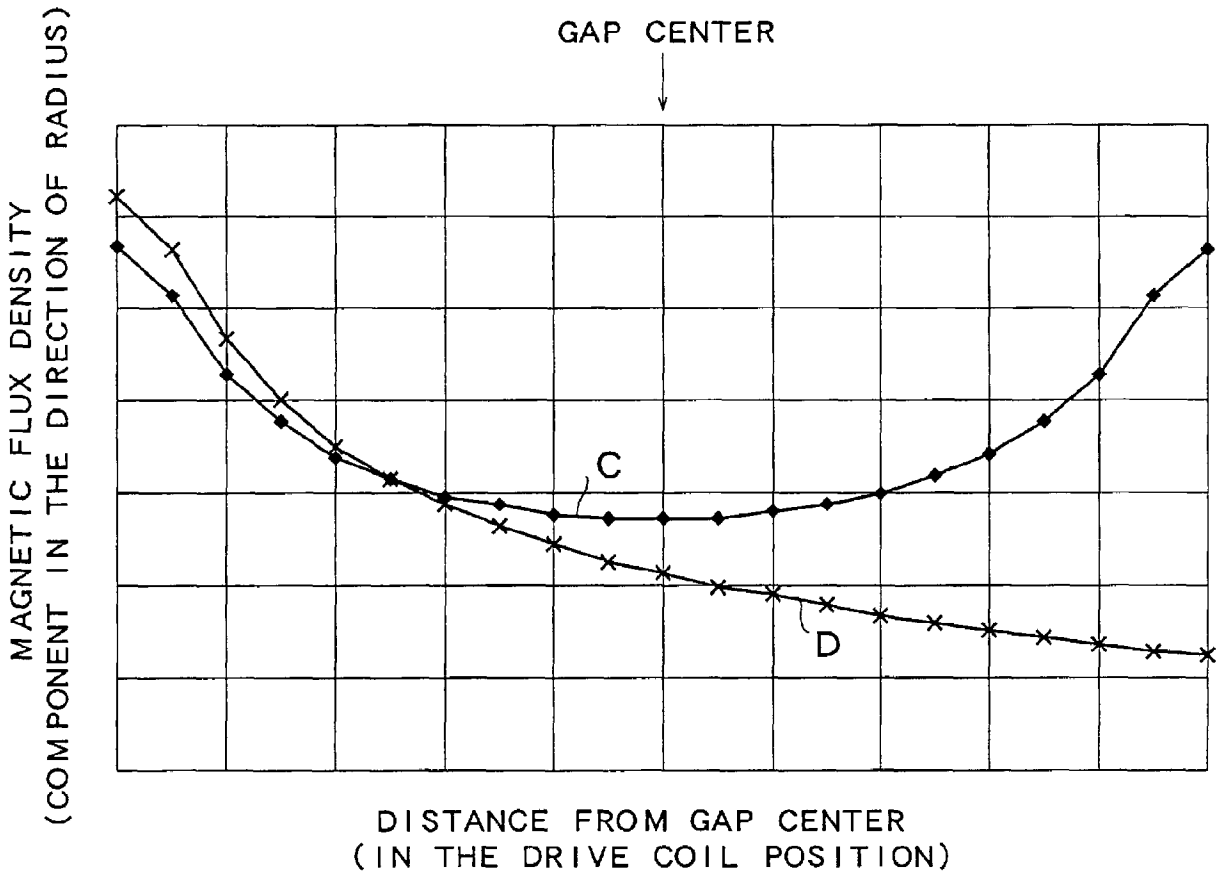
FIG. 6 is a graph showing the relationship between the distance in the direction of vibration from the gap center and the magnetic flux density according to Embodiment 1.

An electro-acoustic transducer of Embodiment 1 of the present invention will be described with reference to FIGS. 2 to 7. FIG. 2A is a cross sectional view of the electro-acoustic transducer, FIG. 2B is a plan view of first and second magnets, and FIG. 2C is a plan view of a drive coil. FIG. 3 is an assembly configuration view of this electro-acoustic transducer, and FIG. 4 illustrates magnetic flux vectors generating due to the first and second magnets. FIG. 5 is a graph showing the relationship between the distance from a center axis 107 in the center portion of a gap G in the radius direction and the magnetic flux density. FIG. 6 is a graph showing the relationship between the distance from the center portion of the gap G in the direction of vibration at the position of the drive coil and the magnetic flux density.

The electro-acoustic transducer of the present embodiment is formed as follows. A first magnet 101 and a second magnet 102, respectively, are held within an upper case 103 and a lower case 104, as shown in FIGS. 2 and 3. The upper case 103 and the lower case 104 are cylindrical members and form a housing when assembled. In addition, they hold a diaphragm 106, having a drive coil 105, at the center portion thereof so that the diaphragm 106 freely vibrates. The first and second magnets 101 and 102 are of cylindrical forms and are, for example, neodymium magnets having an energy product of 44 MGOe. Furthermore, they are magnetized in opposite directions. In a case, for example, the first magnet 101 is magnetized in a downward direction, that is, in the direction from the first magnet to the second magnet, and the second magnet 102 is magnetized in an upward direction, that is, in the direction from the second magnet to the first magnet.

The first and second magnets 101 and 102, are secured on the upper case 103 and the lower case 104 respectively, so that the center axis 107 passing through the respective centers coincide with each other. The upper case 103 and the lower case 104 are made of a non-magnetic material, for example, a resin material such as PC (polycarbonate). Air holes 108 are provided in the upper and lower surfaces of the upper case 103 and the lower case 104, as shown in the figures. In addition, the drive coil 105 is attached to the diaphragm 106 so as to be coaxial with the first and second magnets 101 and 102. The drive coil 105 is, for example, adhered to the diaphragm 106 using adhesive. Then, the periphery portion of the diaphragm 106 is interposed between and secured by the upper case 103 and the lower case 104 so that the drive coil 105 is positioned at the center between the first and second magnets 101 and 102 in the direction of vibration. Here, the position in which the drive coil 105 is provided includes lines connecting the outer peripheries of the first and second magnets 101 and 102.

The operation of the electro-acoustic transducer formed as above will be described in the following. In the case that an alternating current electrical signal is not inputted into the drive coil 105, magnetic flux as shown in FIG. 4 generates due to the first and second magnets 101 and 102. Since the first and second magnets 101 and 102 are magnetized in opposite directions, magnetic flux emitted from the respective magnets repel each other and, as a result, magnetic flux vectors are bent so as to be approximately perpendicular to the direction of emission and form a magnetic field consisting of magnetic flux perpendicular to the direction of vibration.

In such a static magnetic field the relationship between the direction from the center of the gap G, that is, from the center axis 107, in the radius direction and the magnetic flux density is shown, for example, as curve A of FIG. 5. As shown in FIG. 5, the outer peripheries of the first and second magnets 101 and 102 coincide with the peak of the magnetic flux density that the magnetic flux density is at a maximum in the magnetic flux density distribution. Accordingly, the drive coil 105 is placed so that the approximate center of the drive coil 105 in the radius direction is located on lines connecting the outer peripheries of the first and second magnets 101 and 102 in order to obtain driving force in the most efficient manner.

Next, in the case that an alternating current signal is inputted into the drive coil 105, driving force generates proportional to the magnetic flux perpendicular to the direction of current flowing through the drive coil 105 and perpendicular to the direction of vibration of the diaphragm 106. This driving force makes the diaphragm 106, which is adhered to drive coil 105, vibrate so that this vibration is emitted as sound.

As shown in FIGS. 4 and 5, the magnetic flux vectors emitted from the first and second magnets 101 and 102 are dominated by the magnetic flux perpendicular to the direction of current flowing through the drive coil 105 and perpendicular to the direction of vibration of the diaphragm 106. Furthermore, the drive coil 105 is placed so that the magnetic flux density becomes maximum and, therefore, a large driving force is obtained. As a result, the sound pressure of the reproduced sound becomes high.

FIG. 5 shows, as curve B, a component of the magnetic flux density in the radius direction in a conventional configuration where one magnet having the same energy product and the same volume of the sum of the first and second magnets. As is clear from this figure, the conventional configuration has a low peak of magnetic flux density while, in comparison, the configuration of the present embodiment has a sound pressure of the reproduced sound that is approximately 2 dB higher than that of the conventional configuration.

FIG. 6 shows the relationship between the distance from the center portion of the gap G in the direction of vibration at the position of the drive coil and the magnetic flux density when vibrating. The point shown as the gap center indicates the initial position that the alternating current signal is not inputted. By inputting the alternating current signal, the diaphragm 106 vibrates, starting from the initial position to the upward and downward directions, and shifts in the leftward and rightward directions in FIG. 6. As shown with curve C of FIG. 6, symmetry is obtained relative to the amplitude, with the gap center as a reference in the case that the first and second magnets 101 and 102 exist. In the conventional structure with one magnet, however, asymmetry is obtained relative to the amplitude, as shown with curve D. This asymmetry of the driving force causes deterioration of sound quality, as secondary distortion. That is, according to the present embodiment a magnetic circuit structure is employed using the first and second magnets 101 and 102 and, therefore, secondary distortion can be reduced and high sound quality is achieved.

Here, though neodymium magnets are used for the first and second magnets 101 and 102 in the present embodiment, magnets such as those of ferrite, samarium cobalt or the like, can be used in accordance with the target sound pressure, the form or the like.

Figure 7:
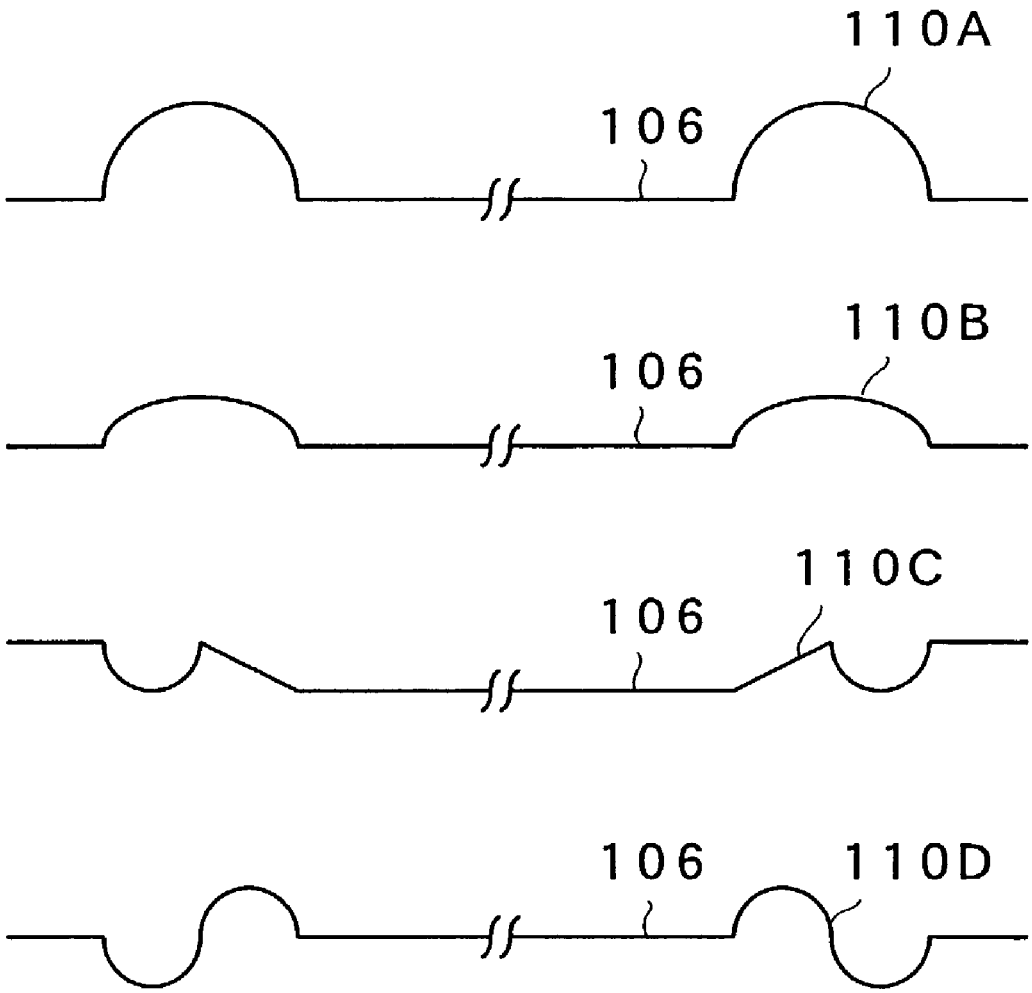
FIG. 7 illustrates examples of edges of Embodiment 1.

In addition, though the form of the diaphragm 106 is approximately flat in FIG. 2, an edge portion 110 can be provided so as to satisfy minimum resonant frequency and maximum amplitude requirements. The edge portion 110 can have a cross section of a semicircular edge 110A, an elliptical edge 110B, a conical form edge 110C, a wave-form edge 110D or the like as shown in FIG. 7.

Here, in the present embodiment, though a non-magnetic material is used for the upper case 103 and the lower case 104, magnetic material can be used. By using magnetic material, leakage of flux of the first and second magnets to the housing side can be reduced.

Here, in the present embodiment, though the first and second magnets 101 and 102 are cylindrical forms, they can be other forms such as a rectangular parallelepiped form or an elliptic cylinder form.

In such a case, the outer shape of the electro-acoustic transducer is made to be of a rectangular or elliptical form and the diaphragm can, correspondingly, be made to be of a rectangular or elliptical form. In addition, since the structure does not require the drive coil to be inserted into a magnetic gap, an electro-acoustic transducer of a long form having a large aspect ratio can be implemented.

Here, in the present embodiment, though the air holes 108 are provided in the upper and lower surfaces of the upper case 103 and the lower case 104, they can be provided in side faces so that the reproduced sound is laterally emitted.

As described above, at least one sound hole is provided in at least one of the upper and lower surfaces and sidewalls of the housing in such a manner so that the configuration allows the sound generated by the diaphragm to be emitted from the sound holes. Thereby an increase in the minimum resonant frequency of the diaphragm due to an increase in the air pressure caused in a space formed of the diaphragm and of the housing can be prevented by means of the sound holes. In particular, the width required for the attachment can be made considerably narrow in the configuration that the housing is of a rectangular parallelepiped wherein sound holes are provided in the sidewalls in the longitudinal direction so that sound is emitted from these sound holes.

Embodiment 2

Figure 8:
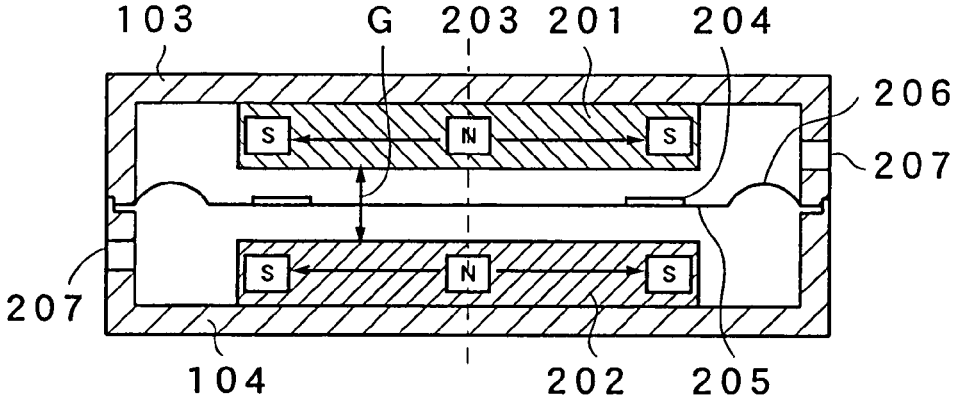
FIG. 8 is a cross sectional view of an electro-acoustic transducer according to Embodiment 2 of the present invention.
Figure 9:
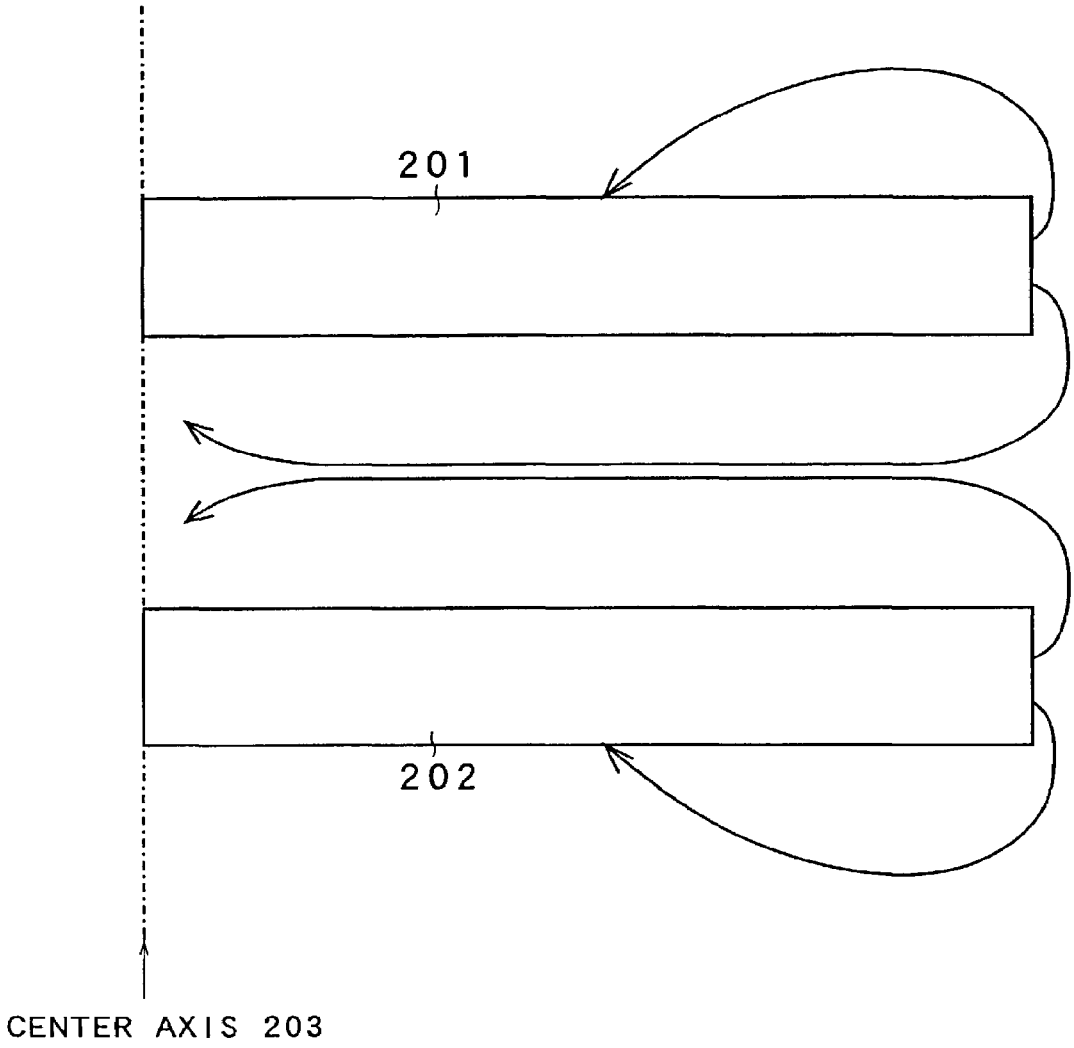
FIG. 9 illustrates magnetic flux vectors generating due to first and second magnets according to Embodiment 2.

FIG. 8 is a cross sectional view of an electro-acoustic transducer according to Embodiment 2 of the present invention, and FIG. 9 illustrates magnetic flux vectors generated by the first and second magnets. The electro-acoustic transducer of Embodiment 2 is formed as follows. An upper case 103 and a lower case 104 are the same as in Embodiment 1 and are integrated to form a housing. A first magnet 201 and a second magnet 202, respectively, are attached to the upper case 103 and the lower case 104. The first and second magnets 201 and 202 are of cylindrical forms and are secured to the upper case 103 and the lower case 104 so that the respective centers thereof coincide with the center axis 203. In addition, a drive coil 204 is adhered on a diaphragm 205 so as to be concentric with the diaphragm 205 relative to the center axis 203. Furthermore, the periphery of the diaphragm 205 is placed between the upper case 103 and the lower case 104 so as to be secured in the same manner as in Embodiment 1. The diaphragm 205 is a member in the form of a thin plate and the outer periphery portion thereof is provided with an edge portion 206.

The diaphragm 205 has a flat form only in the center portion and the edge portion 206 of which the cross section is of a semicircular form is provided in the outer periphery portion, thereby the amplitude can be increased in comparison with the diaphragm in a flat form. In addition, air holes 207 are provided in the sides of the upper case 103 and the lower case 104. Thereby, the electro-acoustic transducer can be attached to electronic device in a direction different from that in Embodiment 1.

As for the direction of magnetization of the first and second magnets 201 and 202, these magnets are both magnetized in the direction from the center axis 203 to the outer periphery of the magnet, that is, in the radius direction, as shown in FIG. 8. Hereinafter, such magnetization is referred to as radial magnetization.

FIG. 9 illustrates magnetic flux vectors. The first and second magnets 201 and 202 are radially magnetized so as to have the same pole in the respective outer peripheries. Since the first and second magnets 201 and 202, magnetized in such a manner, are placed so as to face each other, the magnetic fluxes emitted from the respective magnets repel each other and, as a result, a magnetic field that the components in the radius direction are dominant is formed within the magnetic gap. The drive coil 204 is placed at a position where the magnetic flux density becomes of the maximum within this magnetic gap. When an alternating current signal is inputted to the drive coil 204, a driving force is generated so that the diaphragm 205 vibrates due to this driving force and sound is emitted in the same manner as in Embodiment 1.

Figure 10:
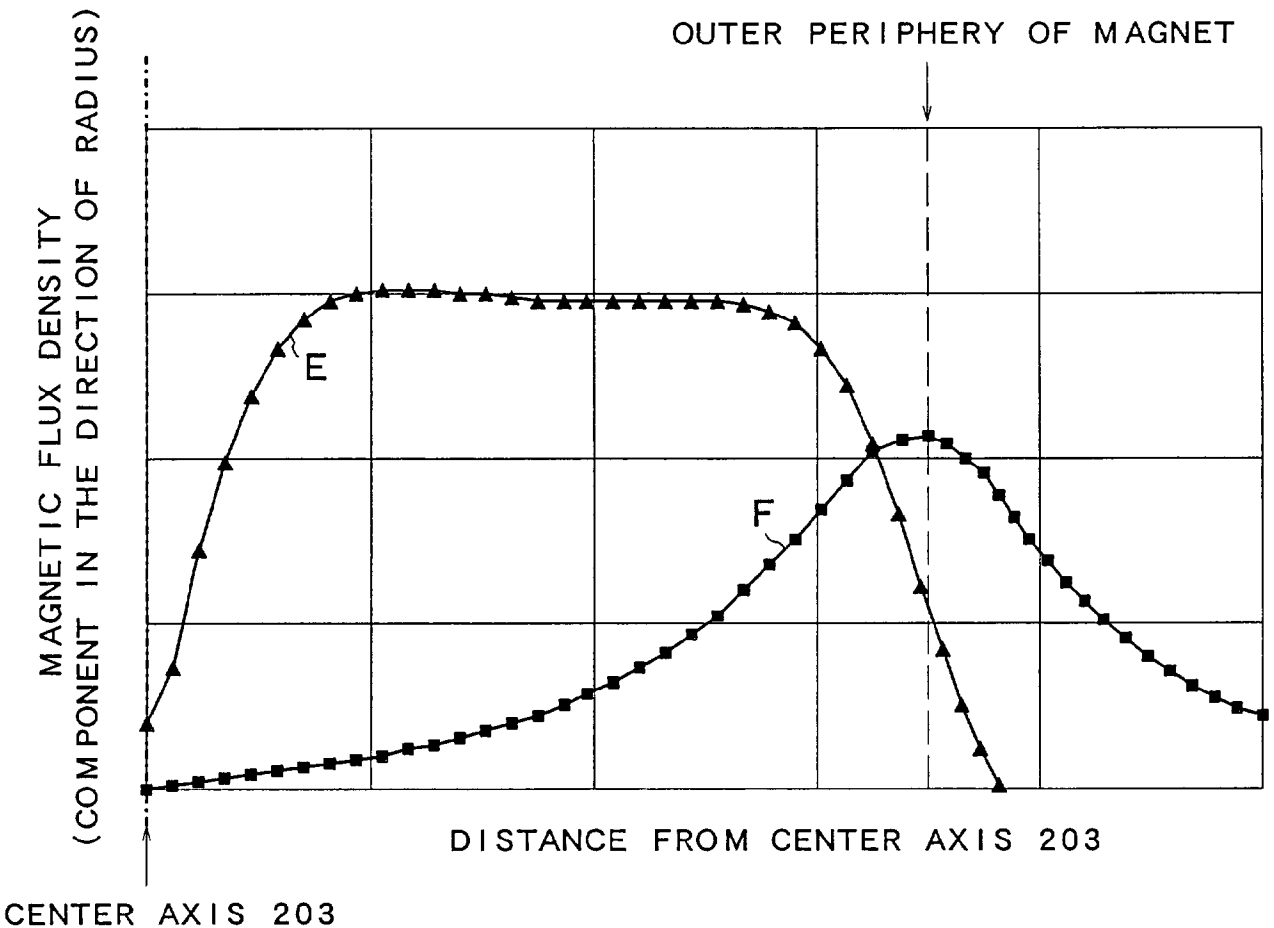
FIG. 10 is a graph showing the relationship between the distance in the radius direction from the center axis and the magnetic flux density according to Embodiment 2.

FIG. 10 shows the relationship between the distance from the center axis 203 in the radius direction and the magnetic flux density. An approximately uniform magnetic field where the component in the radius direction is dominant is formed in a predetermined range at a distance from the center axis 203 and, therefore, a wide flat portion exists, as shown by curve E. Accordingly, a wide range for the installation of the drive coil 204 can be secured. Therefore, the driving force can be enhanced by increasing the number of turns, length and the like, of the drive coil. In addition, since magnetic flux density is distributed approximately uniformly, the magnetic flux density in the direction of vibration changes a little at the position of the drive coil 204. Here, curve F in FIG. 10 is a graph according to the prior art.

Since the magnetization of the first and second magnets, provided on both sides of the diaphragm, are in the direction perpendicular to the direction of vibration of the diaphragm having a center axis passing through the center of the diaphragm as the reference in the above described manner, the magnets can be efficiently utilized. In addition, since a wide range for the installation of the drive coil is secured, the forms of the drive coil and the diaphragm can be designed freely.

Here, in the present embodiment, though the edge 206 of a semicircular form is provided in the outer periphery portion of the diaphragm 205, the cross sectional form of the edge 206 is not limited thereto. It can be determined so as to satisfy the minimum resonant frequency and the maximum amplitude requirements and can be of a wave-form, an elliptical form or a conical form, as shown in FIG. 7.

Here, in the present embodiment, though the first and second magnets 201 and 202, respectively, are made of one radially magnetized magnet, the magnet can be divided into several pieces before being magnetized so as to implement radial magnetization by recombining them.

Here, though a non-magnetic material is used for the upper case 103 and the lower case 104, a magnetic material can be used. By using magnetic material, leakage of magnetic flux from the first and second magnets to the housing side can be reduced.

Here, in the present embodiment, though the first and second magnets 201 and 202 are of cylindrical forms, they can be of other forms such as an elliptical cylinder form or a rectangular parallelepiped form in accordance with the external form of the electro-acoustic transducer.

Here, in the present embodiment, though the air holes 207 are provided on the sidewalls of the upper case 103 and the lower case 104, they can be provided on the upper and lower surfaces.

Embodiment 3

Figure 11:
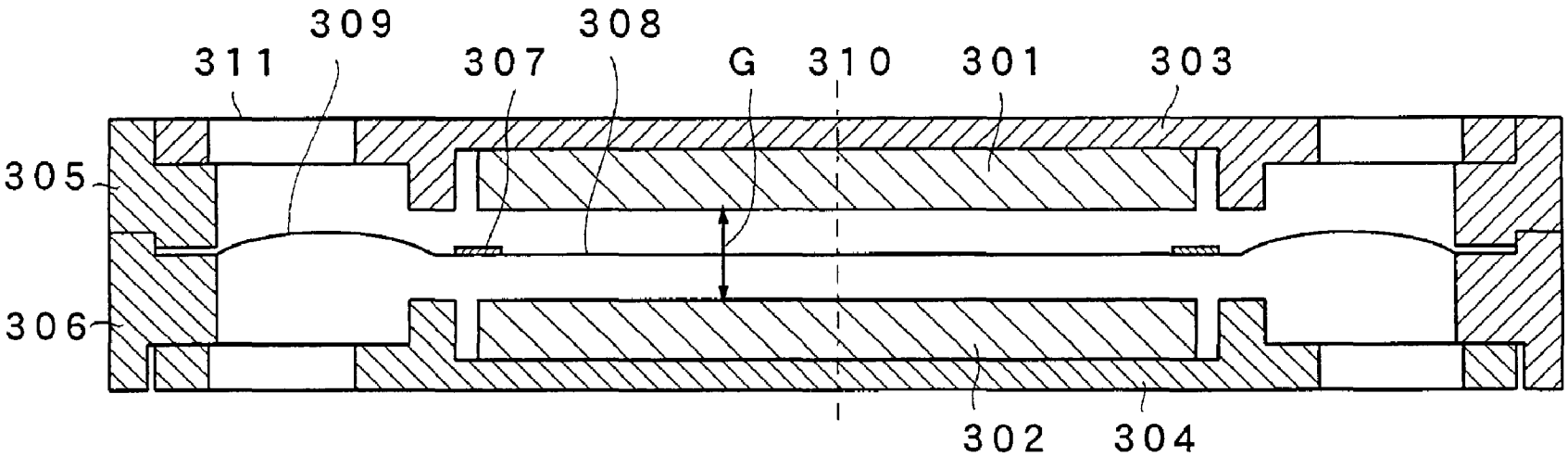
FIG. 11 is a cross sectional view of an electro-acoustic transducer according to Embodiment 3 of the present invention.
Figure 12:
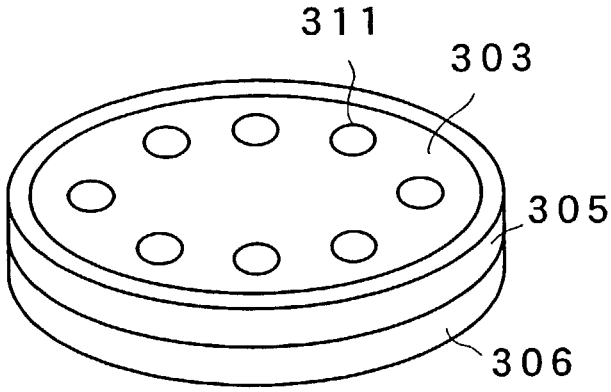
FIG. 12 is a perspective view of the electro-acoustic transducer according to Embodiment 3.

FIG. 11 is a cross sectional view of an electro-acoustic transducer according to Embodiment 3 of the present invention, and FIG. 12 is a perspective view thereof. The electro-acoustic transducer of the present embodiment is formed as follows. First and second yokes 303 and 304 are provided around first and second magnets 301 and 302. The first and second yokes 303 and 304 are made of a magnetic material such as iron. Then, the first and second yokes 303, 304, the upper case 305 and the lower case 306, in frame forms, form a housing. In addition, a diaphragm 308 having a drive coil 307 is held in the center portion of the housing so that the diaphragm can freely vibrate. An edge 309 in an arc form is provided in the outer periphery portion of the diaphragm 308. The first and second magnets 301 and 302 are of cylindrical forms and are made of neodymium magnets, of which the energy product is, for example, 44 MGOe. Furthermore, the directions of magnetization are opposite to each other and, in the case that the first magnet 301 magnetized in, for example, the upward direction, that is, in the direction from the second magnet to the first magnet, the second magnet 302 is magnetized in the downward direction, that is, in the direction from the first magnet to the second magnet.

The first and second magnets 301 and 302 are secured to the yokes 303 and 304, respectively so that axes 310 passing through the respective centers of the magnets coincide with each other. Air holes 311 are provided on the upper surface and on the lower surface of the yokes 303 and 304, as shown in the figure. In addition, the drive coil 307 is attached to the diaphragm 308 so as to be concentric with the first and second magnets 301 and 302. The drive coil 307 is, for example, adhered to the diaphragm 308 using adhesive. Then, periphery portion of the diaphragm 308 is placed and secured between the upper case 305 and the lower case 306 so that the drive coil 307 is located at the center in the direction of amplitude between the first and second magnets 301 and 302. The air holes 311 are provided in the yokes 303 and 304.

The operation and effects of the electro-acoustic transducer, formed as above, are described in the following. When an alternating current signal is inputted into the drive coil 307, a driving force is generated in the same manner as in Embodiment 1 and the diaphragm 308 adhered to the drive coil 307 vibrates due to this driving force so as to emit sound.

The first and second yokes 303 and 304 are added to surround the first and second magnets 301 and 302 so that the first magnet 301 and the first yoke 303, as well as the second magnet 302 and the second yoke 304, respectively, form magnetic paths. Therefore, the magnetic flux emitted from the first and second magnets 301 and 302 is lead to the magnetic gap G by means of the first and second yokes 303 and 304 so that the magnetic flux density within the magnetic gap G becomes high. In the present embodiment the drive coil 307 is placed at a position where the magnetic flux density becomes maximum within this magnetic gap G, that is, the drive coil 307 is placed so that the position includes lines connecting the outer peripheries of the first and second magnets 301 and 302.

As a result, the magnetic flux density also becomes high at the position of the drive coil 307 and, therefore, the driving force which is proportional to the magnetic flux density also becomes large leading to an increase in the sound pressure of the reproduced sound. In the case that neodymium magnets having a diameter of 7 mm and a height of 0.5 mm are used, the magnetic flux density obtained at the drive coil 307 becomes 1.5 times greater than the case where the first and second yokes are not present and the sound pressure becomes higher by 3.8 dB. In addition, by providing the yokes, leakage of magnetic flux to the outside of the electro-acoustic transducer can be prevented.

The first and second yokes are provided around the first and second magnets, respectively, in the above described manner, thereby the magnetic flux from the first and second magnets converge by means of the first and second yokes. Therefore, the driving force generated at the drive coil is further increased so that the sound pressure of the reproduced sound becomes higher.

Here, in the present embodiment, though the first yoke and the upper case, as well as the second yoke and the lower case, respectively, are separate members, they can be integrated members, respectively, made of magnetic material. Thereby, the number of components can be reduced.

Here, in the present embodiment, though the first and second magnets 301 and 302 are of cylindrical forms, they can be of other forms such as of an elliptical cylinder form or a rectangular parallelepiped form in accordance with the external form of the electro-acoustic transducer.

Figure 13A:
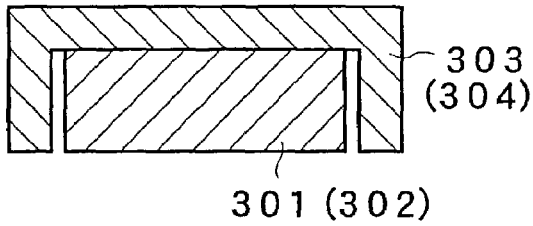
FIG. 13A is a schematic view (1) showing the relationship between a magnet and a yoke according to Embodiment 3.
Figure 13B:
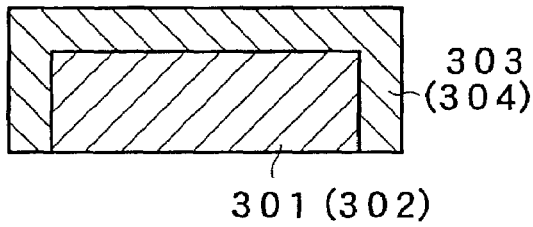
FIG. 13B is a schematic view (2) showing the relationship between the magnet and the yoke according to Embodiment 3.
Figure 13C:
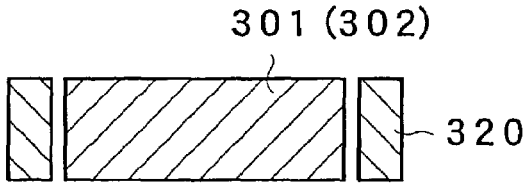
FIG. 13C is a schematic view (3) showing the relationship between the magnet and the yoke according to Embodiment 3.
Figure 13D:
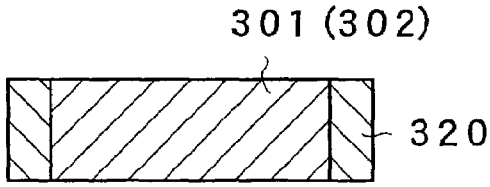
FIG. 13D is a schematic view (4) showing the relationship between the magnet and the yoke according to Embodiment 3.
Figure 13E:
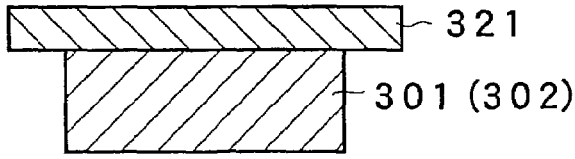
FIG. 13E is a schematic view (5) showing the relationship between the magnet and the yoke according to Embodiment 3.

Here, in the present embodiment, a slit is provided between the inner periphery portions of the first and second yokes and the outer periphery portions of the first and second magnets. FIG. 13A is a schematic diagram showing the relationship between such yokes and magnets. In contrast to this, the outer periphery portions of the first and second magnets 301 and 302 and the inner periphery portions of the first and second yokes 303 and 304 can make direct contact, without a slit, as shown in the schematic diagram of FIG. 13B, in order to reduce the external diameter of the electro-acoustic transducer or in order to expand the arc portion provided in the outer periphery portion of the diaphragm. In addition, as shown in FIG. 13C, a yoke 320 can be provided solely on the sides of the magnets 301 and 302 and in this case, also, the yoke 320 can make direct contact with the magnets, as shown in FIG. 13D. Furthermore, yokes 321 can be placed on the flat surface portions of the magnets, as shown in FIG. 13E. At this time, in the case that the first and second magnets are of rectangular parallelepiped forms, the first and second yokes are provided around the extended outer peripheries of at least two sides that are not opposed to the diaphragm. The yokes are not placed in portions facing the diaphragm, as shown in all of the diagrams of FIGS. 13A to 13E.

Here, though FIGS. 13A to 13D show the surfaces of the magnets and the surfaces of the yokes in the same planes on the sides facing the diaphragm, they can be formed so as not to be in the same planes having steps in accordance with the form of the diaphragm, the maximum amplitude value and the like.

Here, in the present embodiment, though the air holes 311 are provided on the upper and lower surfaces of the yokes 303 and 304, they can be provided in the upper case 305 and the lower case 306 so as to laterally emit the reproduced sound.

Embodiment 4

Figure 14A:
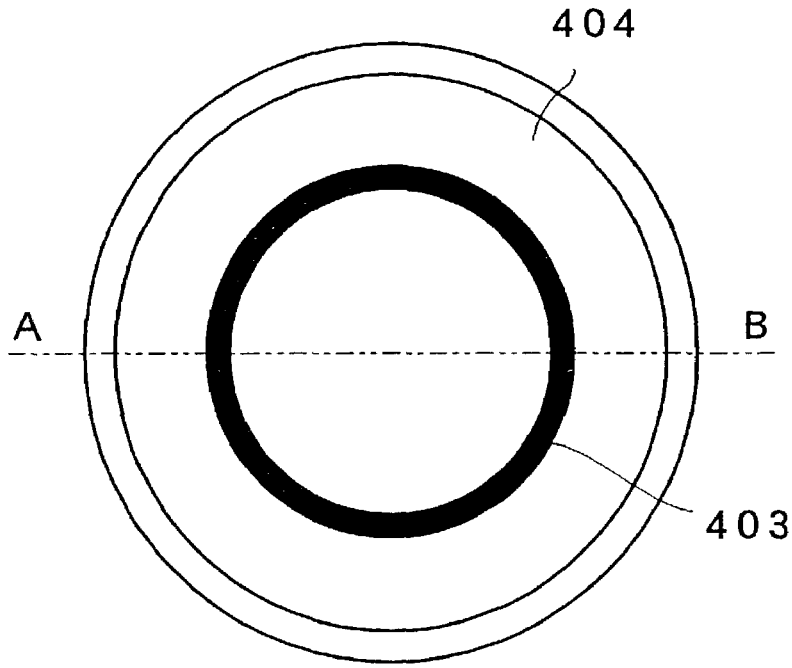
FIG. 14A is a plan view of a diaphragm and a drive coil according to Embodiment 4 of the present invention.
Figure 14B:
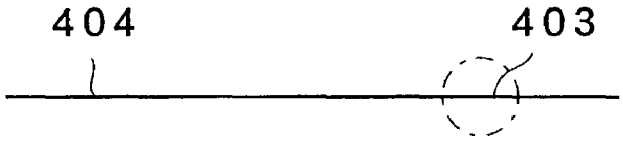
FIG. 14B is a cross sectional view of the diaphragm and the drive coil according to Embodiment 4.
Figure 14C:
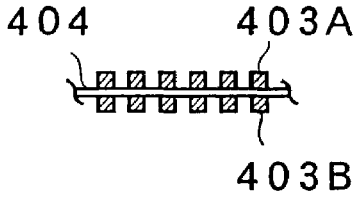
FIG. 14C is a partially enlarged cross sectional view of the diaphragm and the drive coil according to Embodiment 4.

FIG. 14A is a plan view of a diaphragm and a drive coil according to Embodiment 4 of the present invention, FIG. 14B is a cross sectional view taken along line A–B of FIG. 14A, and FIG. 14C is an enlarged cross sectional view of the circled portion of FIG. 14B. These figures show a diaphragm 404 to which a drive coil 403 is attached. As for the other components, the same components as in Embodiments 1 to 3 are used to form an electro-acoustic transducer. The diaphragm 404 is of a flat disk form in the same manner as in Embodiment 1.

The present embodiment differs from the other embodiments in the point that the drive coil 403 is integrated with the diaphragm 404. An etching method which is one technique for integrally forming the drive coil 403 and the diaphragm 404 will be described in the following. First, copper is laminated using adhesive onto the base of the diaphragm, made of polyimide, for example. A photoresist layer is formed on top of that and, then, is exposed and developed so as to form an etching resist in a coil form on the copper. Next, etching is carried out, then the resist is removed, thereby a coil wire is formed on the base of the diaphragm. A drive coil can be formed on one surface of the diaphragm 404 or drive coils can be formed on both surfaces of the diaphragm 404. FIGS. 14B and 14C show that first and second coils 403A and 403B are formed on both of front and rear surfaces of the diaphragm 404 according to this method and they are connected to form the drive coil.

Here, though an etching method is shown as a technique for integration, an additive method can be used.

Here, in the present embodiment, though the drive coil has a two-layer structure, it can have a one-layer structure or three or more layers can be laminated.

Figure 15A:
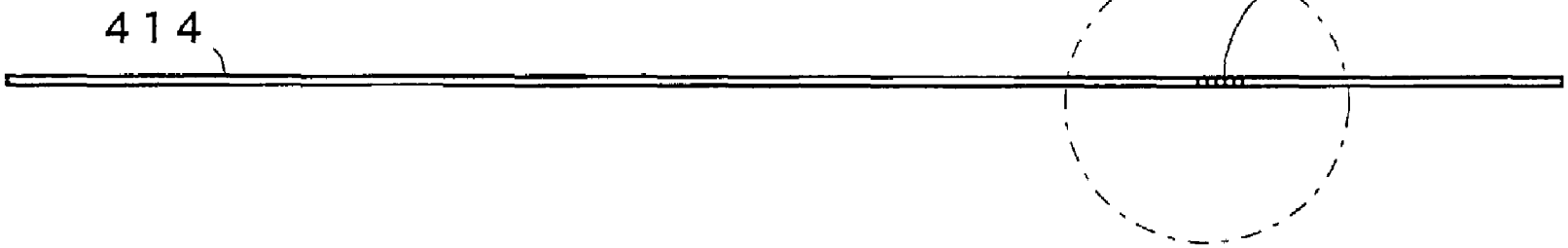
FIG. 15A is a side view of a diaphragm and a drive coil according to another example of Embodiment 4.
Figure 15B:
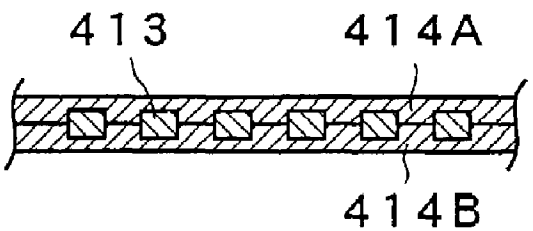
FIG. 15B is a partially enlarged cross sectional view of the diaphragm and the drive coil according to another example of Embodiment 4.

Another integration technique is explained referring to FIG. 15. FIG. 15A is a side view showing a diaphragm to which the drive coil 413 is attached, and FIG. 15B is a partially enlarged cross sectional view thereof. In this example, first and second diaphragms 414A and 414B are used at the time formation that the drive coil 413 is placed between the two diaphragms, thereby a sandwich structure of the diaphragm 414A-drive coil 413-diaphragm 414B is formed.

By integrating the drive coil and the diaphragm in such a manner, stress generated in the drive coil when vibrating can be reduced. Accordingly, breaking of the drive coil can be avoided and reliability can be enhanced.

The drive coil is integrally formed with the diaphragm through deposition, printing or the like, without the use of a winding and, therefore, input withstanding increases. In addition, since an adhesive process and lead wiring are omitted, automatic production becomes possible and reliability can be enhanced at the time of great vibration.

Embodiment 5

An electro-acoustic transducer of Embodiment 5 of the present invention will be described with reference to figures.

Figure 16A:
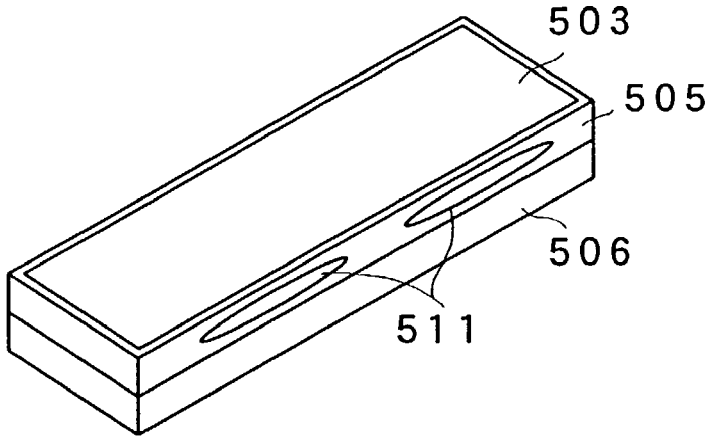
FIG. 16A is a perspective view of an electro-acoustic transducer according to Embodiment 5 of the present invention.
Figure 16B:
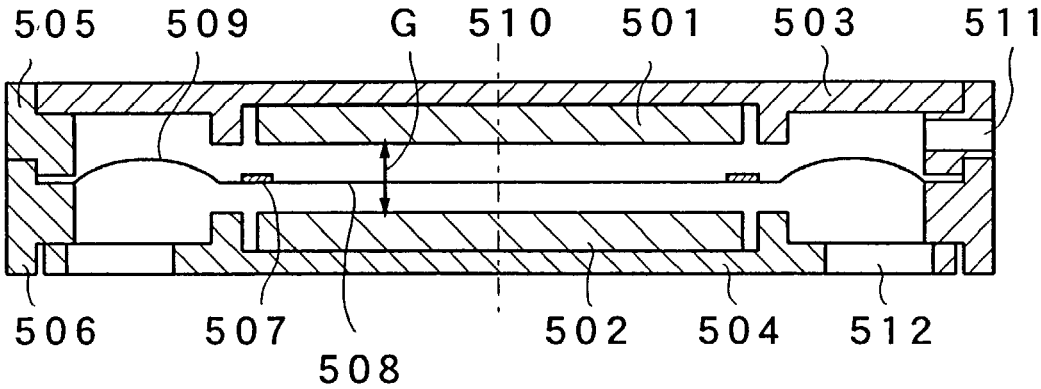
FIG. 16B is a cross sectional view of the electro-acoustic transducer according to Embodiment 5.
Figure 17A:
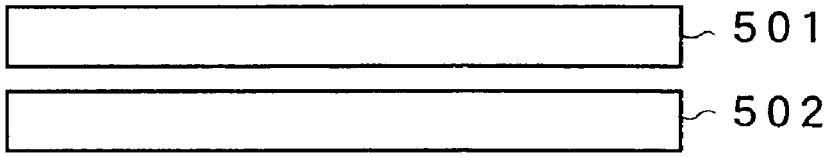
FIG. 17A is a plan view of first and second magnets according to Embodiment 5.
Figure 17B:
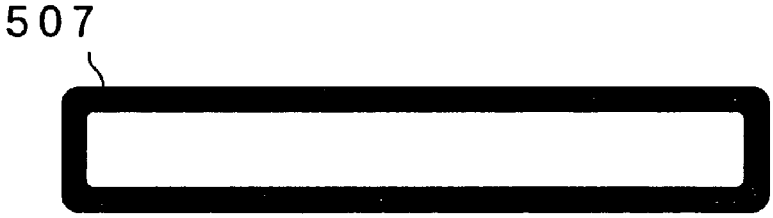
FIG. 17B is a plan view of a drive coil according to Embodiment 5.
Figure 17C:
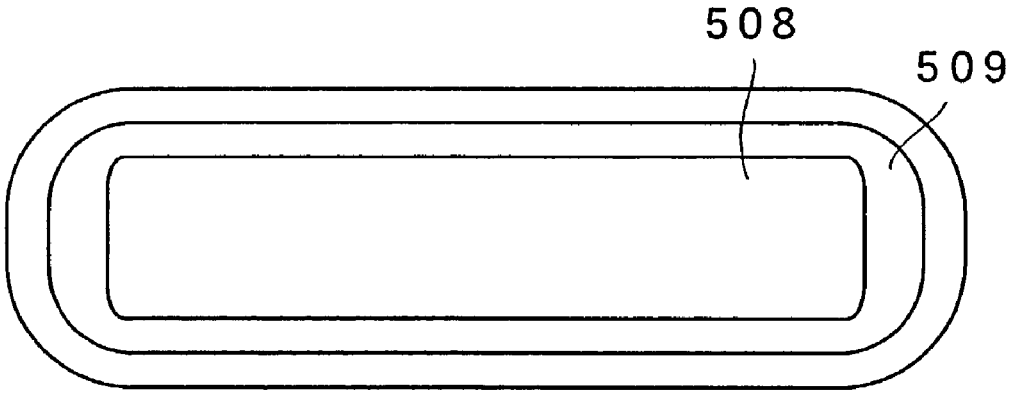
FIG. 17C is a plan view of a diaphragm according to Embodiment 5.

FIG. 16A is a perspective view of the electro-acoustic transducer, and FIG. 16B is a cross sectional view thereof. FIG. 17A is a plan view of first and second magnets, FIG. 17B is a plan view of a drive coil, and FIG. 17C is a plan view of a diaphragm.

The electro-acoustic transducer is formed as follows. First and second yokes 503 and 504 are provided around first and second magnets 501 and 502 in FIGS. 16A and 16B. The first and second yokes 503 and 504 are made of a magnetic material such as, for example, iron. Then, the first and second yokes 503, 504, an upper case 505 and a lower case 506 of frame shape form a housing. The upper case 505 and the lower case 506 are made of a non-magnetic material and are made of a resin material such as, for example, PC (polycarbonate). In addition, a diaphragm 508 having a drive coil 507 is held between the cases in the center of the housing so that the diaphragm 508 can freely vibrate. The diaphragm 508 has an edge 509, in an arc form, in the periphery portion. The first and second magnets 501 and 502 are of rectangular parallelepiped forms and are neodymium magnets having an energy product of, for example, 38 MGOe. Furthermore, their directions of magnetization are opposite to each other relative to the direction of vibration of the diaphragm as a reference and, in the case that the first magnet 501 is, for example, magnetized in the upward direction, that is, in the direction from the second direction to the first magnet, the second magnet 502 is magnetized in the downward direction, that is, in the direction from the first direction to the second magnet.

The first and second magnets 501 and 502 are secured to the yokes 503 and 504 so as to share the center axis 510, which passes through the centers of the respective magnets, as well as the major axis and the minor axis. In addition, air holes 511 and 512, respectively, are provided on a side of the upper case 505 and the bottom of the second yoke 504. In addition, the drive coil 507 has a rectangular form in the same manner as the first and second magnets 501 and 502 and is attached to the diaphragm 508 so that the major axis and the minor axis coincide with each other. The drive coil 507 is, for example, adhered to the diaphragm 508 using an adhesive. Then, the periphery portion of the diaphragm 508 is placed and secured between the upper case 505 and the lower case 506 so that the drive coil 507 is located at the center between the first and second magnets 501 and 502 in the direction of vibration. In addition, the external form of the diaphragm 508 is an elliptical form and the outside portion to which the drive coil 507 is attached is of an approximately semicircular form.

The operation and effects of the electro-acoustic transducer, formed as above, are described in the following.

The first and second magnets 501, 502 and the first and second yokes 503, 504 form a magnetic field. The drive coil 507 is placed within the magnetic gap G thereof so that the magnetic flux density becomes maximum. When an alternating current signal is inputted into the drive coil 507, a driving force is generated and this driving force makes the diaphragm 508, which is adhered to the drive coil 507, vibrate so as to emit sound in the same manner as in Embodiment 1. In addition, the first and second yokes 503 and 504 surround the first and second magnets 501 and 502 so that the first magnet 501 and the first yoke 503, as well as the second magnet 502 and the second yoke 504, respectively, form magnetic paths. Thereby, the magnetic flux emitted from the first and second magnets 501 and 502 is led to the magnetic gap G by means of the first and second yokes so as to obtain a high magnetic flux density within the magnetic gap G in the same manner as in Embodiment 3.

The present embodiment differs from Embodiment 1 and Embodiment 3 in the point that the first and second magnets 501, 502 and the drive coil 507 have rectangular forms and the external form of the diaphragm 508 is approximately an elliptical form and, moreover, the external form of the electro-acoustic transducer shown in the present embodiment is a rectangular parallelepiped form. In addition, the air holes 511 and 512 are provided in the lower surface and in a side of the electro-acoustic transducer shown in the present embodiment.

Since the electro-acoustic transducer is made of a rectangular parallelepiped form, the space factor at the time of assembly in a cellular phone or in a portable information terminal such as a PDA can be improved.

In addition, the air holes 511 are provided in the upper case 505, thereby the surface with the air holes 511 can be used as the surface attached to electronic device so that an electro-acoustic transducer having long sound holes can be implemented.

It is difficult for the drive coil, which is prepared by winding a copper wire, to be formed into an elliptical or rectangular form in comparison with a circular form because of processing reasons. In particular, in the case of a form having a large aspect ratio, making the width of the winding of the coil uniform is difficult.

In electro-acoustic transducer according to the present embodiment, it is not necessary to insert the drive coil into a magnetic gap as in the conventional electrodynamic-type electro-acoustic transducer but, rather, the drive coil can be present in a space between the first and second magnets 501 and 502. Therefore, it is not necessary to make the width of the winding of the drive coil 507 uniform. As a result, the aspect ratio of the drive coil 507 freely designed so that an elliptical or rectangular electro-acoustic transducer having a large aspect ratio can be implemented.

In the present embodiment, though the air holes 511 and 512 are provided in the side and bottom surfaces so that the surface with the air holes 511 is used for attachment, air holes can be provided in any surface from among the six surfaces forming the electro-acoustic transducer. In addition, it is possible to use any surface as the surface for attachment.

Here, in the present embodiment, an air gap is provided between the inner periphery portions of the first and second yokes and the outer periphery portions of the first and second magnets. However, the outer periphery portions of the first and second magnets and the inner periphery portions of the first and second yokes can make contact with each other without an air gap for the purpose of reduction of size of the external form of the electro-acoustic transducer, or increase the distance between the drive coil and the housing, or the like.

Here, in the present embodiment, though the first and second yokes and the housing are formed of separate members, an integrated member made of a magnetic material can be used. As a result, the number of components can be reduced.

Here, in the present embodiment, though the first and second magnets are of rectangular parallelepiped forms and the drive coil is of a rectangular form, they can be of elliptical cylindrical forms and an elliptical form, respectively.

Here, in the present embodiment, though neodymium magnets are used for the first and second magnets 501 and 502, magnets such as of ferrite or of samarium cobalt can be used in accordance with the targeted sound pressure, with the form, and the like.

In addition, a damp cloth can be provided over the air holes in order to control the Q factor of the lowest resonant frequency.

Here, in the present embodiment, though a wound coil is used as the drive coil, and the diaphragm and the drive coil are separate members, the diaphragm and the drive coil can be integrated as shown in Embodiment 4.

Embodiment 6

Figure 18A:
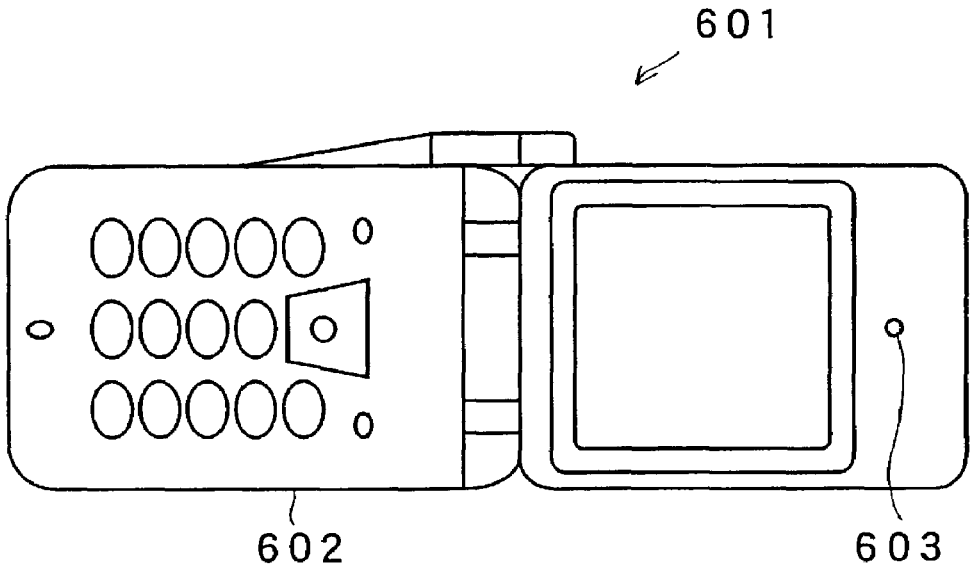
FIG. 18A is a front view of a cellular phone according to Embodiment 6 of the present invention.

A cellular phone, which is one type of electronic device provided with an electro-acoustic transducer as shown in Embodiments 1 to 3 and 5 of the present invention, will be described with reference to the drawings. FIG. 18A is a front view of the cellular phone, FIG. 18B is a fractured side view thereof, and FIG. 19 is a block diagram showing a schematic configuration of the cellular phone.

Figure 18B:
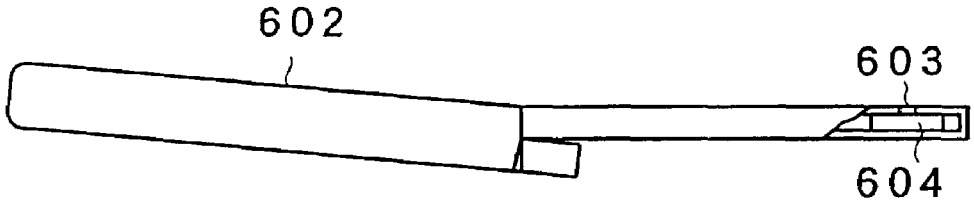
FIG. 18B is a side view of the cellular phone according to Embodiment 6.

In FIGS. 18A and 18B, the entire cellular phone is denoted as 601 wherein a sound hole 603 is provided in an upper portion of a housing 602 of the cellular phone and an electro-acoustic transducer 604 as shown in the abovementioned Embodiments is provided inside of this portion. The electro-acoustic transducer 604 is provided so that a sound hole provided in the case thereof faces the sound hole 603.

Figure 19:
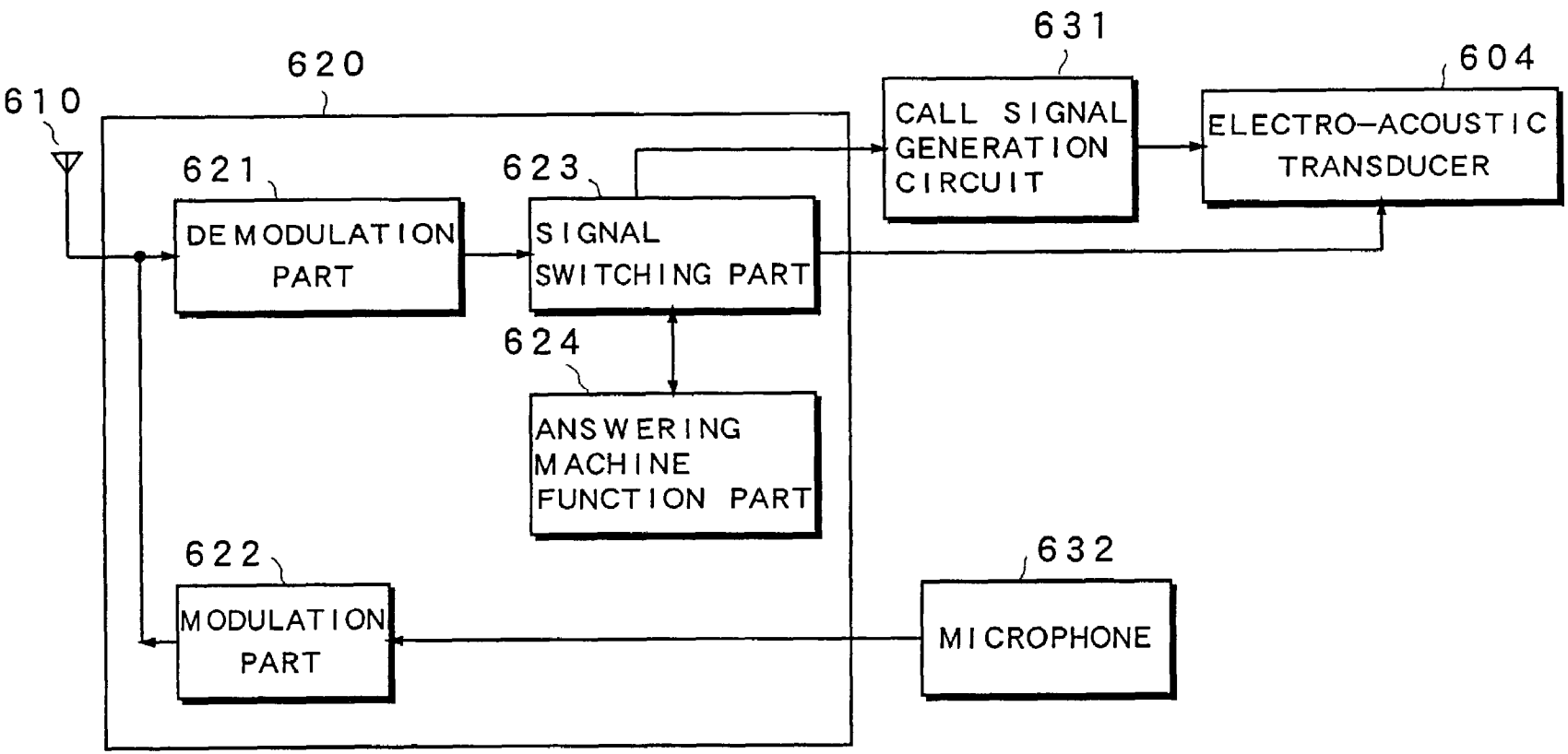
FIG. 19 is a block diagram showing a schematic configuration of the cellular phone according to Embodiment 6.

In FIG. 19 an antenna 610 is connected to a transmission/reception circuit 620. A call signal generation circuit 631 and a microphone 632 are connected to the transmission/reception circuit 620 and the electro-acoustic transducer 604 is connected to the call signal generation circuit 631. In addition, the transmission/reception circuit 620 has a demodulation part 621, a modulation part 622, a signal switching part 623 and an answering machine function part 624.

The antenna 610 receives radio waves outputted from the closest base station and transmits radio waves to the base station. The demodulation part 621 is a circuit that decodes modulated waves which have been inputted from the antenna 610 and converts the modulated waves into a received signal and, then, provides the received signal to the signal switching part 623. The signal switching part 623 is a circuit that switches signal processes in accordance with the content of the received signal. In the case that the received signal is a call signal, it is provided to the call signal generation circuit 631, in the case that the received signal is a speech sound signal it is provided to the electro-acoustic transducer 604 and in the case that the received signal is a speech sound signal from the answering machine, it is provided to the answering machine function part 624. The answering machine function part 624 is formed of, for example, a semiconductor memory. A message for the answering machine at the time when the power is on is recorded by the answering machine function part 624. A message for the answering machine at the time when the cellular phone is out of the service area or when the power is off is recorded by a memory device in the base station.

The call signal generation circuit 631 is a circuit that generates a call signal, which is provided to the electro-acoustic transducer 604.

A compact microphone 632 is provided as an electro-acoustic transducer in the same manner as in a conventional cellular phone. The modulation part 622 is a circuit that modulates a dial signal or a speech sound signal that has been converted by the microphone 632 and outputs them to the antenna 610.

The operation of the cellular phone will be described in the following. The antenna 610 receives radio waves outputted from the base station. The demodulation part 621 demodulates a received base-band signal. When the signal switching circuit 623 detects a call signal from an arrival signal, the arrival signal is outputted to the call signal generation circuit 631 in order to inform the user of the cellular phone of an incoming call.

When the call signal generation circuit 631 receives such an arrival signal, it outputs a call signal, which is a signal for a pure tone in the audible band or for a complex tone of pure tones. The user is informed of the incoming call by hearing this ringtone outputted from the electro-acoustic transducer 604 through the sound hole 603 provided in the cellular phone.

When the cellular phone is in the condition of being used as receiving the call, the signal switching part 623 directly outputs a speech sound signal to the electro-acoustic transducer 604 after the level of the received signal is adjusted. The electro-acoustic transducer 604 operates as a receiver or as a speaker so as to reproduce a speech sound signal.

In addition, speech sound of the user is collected by the microphone 632 and is converted to an electrical signal so as to be inputted to the modulation part 622. Then, the speech sound signal is modulated and is converted to a predetermined carrier wave so as to be outputted from the antenna 610.

In the case that the user of the cellular phone has turned on the power and has set the cellular phone so that the answering machine is in the activated condition, the transmitted speech sound is recorded in the answering machine function part 624. In the case that the user of the cellular phone has turned off the power, the transmitted speech sound is temporarily recorded at the base station. Then, when the user makes a reproduction request to the answering machine by means of a key operation, the signal switching part 623 receives this request and acquires the recorded message from the answering machine function part 624 or from the base station. Then this speech sound signal is adjusted to be at a level suitable for the speaker and is outputted to the electro-acoustic transducer 604. At this time, the electro-acoustic transducer 604 operates as a receiver or a speaker so as to output the message.

Here, in Embodiment 6, though the electro-acoustic transducer is directly attached to the housing, it can be attached to a substrate built into the cellular phone so as to be connected to the housing via an audio port. In addition, the same operation and effects are obtained when the electro-acoustic transducer is attached to another type of electronic device such as a PDA, a TV, a personal computer, a car navigation system or the like.

The electro-acoustic transducer can be built into a variety of types of electronic device so that electronic device that can reproduce alarm sounds, speech sound or the like can be implemented.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese priority applications No. 2001-310914 filed on Oct. 9, 2001 and No. 2002-135152 filed on May 10, 2002 is hereby incorporated by reference.

What is claimed is:

1. An electro-acoustic transducer comprising:

a diaphragm;

a housing comprising an upper case and a lower case and which supports a peripheral surface of said diaphragm within said upper and lower cases;

a sole first magnet disposed on said upper case so as to face a surface of said diaphragm;

a sole second magnet disposed on said lower case so as to face another surface of said diaphragm; and a drive coil which is provided in contact with said diaphragm so as to be coaxial with said first and second magnets and which is positioned so that a line parallel to a center axis of said drive coil which contacts a peripheral surface of one surface of said first magnet and a peripheral surface of said second magnet, passes through said drive coil, wherein said diaphragm is disposed between said first and second magnets; and said first and second magnets are magnetized in directions that are opposite to each other and so that magnetic flux extends through each of said first and second magnets in a direction parallel to a direction in which said diaphragm vibrates.

2. The electro-acoustic transducer according to claim 1, wherein said diaphragm has a form selected from the group consisting of a circular form, a rectangular form and an elliptical form.

3. The electro-acoustic transducer according to claim 1, wherein said first and second magnets have a form selected from the group consisting of a cylindrical form, a rectangular parallelepiped form and an elliptical cylinder form.

4. The electro-acoustic transducer according to claim 1, wherein said drive coil has a form selected from the group consisting of a circular form, a rectangular form and an elliptical form.

5. The electro-acoustic transducer according to claim 1, further comprising:

a first yoke which forms a magnetic path in at least a portion of the periphery of said first magnet; and a second yoke which forms a magnetic path in at least a portion of the periphery of said second magnet.

6. The electro-acoustic transducer according to claim 5, wherein said first and second yokes are disposed outside of said first and second magnets relative to said diaphragm.

7. The electro-acoustic transducer according to claim 5, wherein said first and second yokes are provided on an outer surface and sidewalls of said magnets.

8. The electro-acoustic transducer according to claim 5, wherein said drive coil is of a rectangular form, said first and second magnets are of rectangular parallelepiped forms, and said first and second yokes are provided around outer peripheries obtained by extending at least two sides of each of said first and second magnets.

9. The electro-acoustic transducer according to claim 5, wherein air gaps are provided between said first yoke and outer peripheries of said first magnet and between said second yoke and outer peripheries of said second magnet.

10. The electro-acoustic transducer according to claim 5, wherein at least a portion of said housing includes said first and second yokes.

11. The electro-acoustic transducer according to claim 5, wherein said drive coil is provided inside of the outer periphery portions of said first and second yokes.

12. The electro-acoustic transducer according to claim 1, wherein said drive coil is integrally formed with said diaphragm.

13. The electro-acoustic transducer according to claim 12, wherein said drive coil is deposited or printed on said diaphragm.

14. The electro-acoustic transducer according to claim 12, wherein said drive coil includes first and second drive coils, and said first and second drive coils are disposed on an upper surface and on a lower surface of said diaphragm, respectively.

15. The electro-acoustic transducer according to claim 13, wherein said diaphragm includes first and second diaphragms, and said drive coil is provided between said first and second diaphragms.

16. The electro-acoustic transducer according to claim 1, wherein said electro-acoustic transducer has a configuration that at least one sound hole is provided in at least one of upper and lower surfaces and sidewalls of said housing.

17. The electro-acoustic transducer according to claim 1, wherein an edge portion of said diaphragm has a form selected from the group consisting of a semicircular edge, an elliptical edge, a conical form edge, and a wave-form edge.

18. The electro-acoustic transducer according to claim 1, further comprising:

a first yoke is provided in contact with an outer periphery of said first magnet and a second yoke is provided in contact with an outer periphery of said second magnet.

19. An electro-acoustic transducer comprising:

a diaphragm;

a housing comprising an upper case and a lower case and which supports a peripheral surface of said diaphragm within said upper and lower cases;

a first magnet disposed on said upper case so as to face a surface of said diaphragm;

a second magnet disposed on said lower case so as to face another surface of said diaphragm; and a drive coil which is provided in contact with said diaphragm so as to be coaxial with said first and second magnets and which is positioned between 1) a line defined parallel to a center axis of said drive coil which contacts a first portion of a peripheral surface of said first magnet and a first portion of a peripheral surface of said second magnet and 2) another line defined parallel to the center axis of said drive coil at an opposite side of said drive coil which contacts a second portion of the peripheral surface of said first magnet and a second portion of the peripheral surface of said second magnet, wherein said diaphragm is disposed between said first and second magnets; and said first and second magnets are each magnetized in a radial direction from a center axis thereof, which also passes through a center of said diaphragm, to an outer periphery thereof so that magnetic flux extends from the center axis of said magnets to the outer periphery thereof.

20. The electro-acoustic transducer according to claim 19, wherein said drive coil is provided in a position where said first and second magnets generate the highest magnetic flux density, in a direction perpendicular to a direction of vibration of said diaphragm.

21. The electro-acoustic transducer according to claim 19, wherein said diaphragm has a form selected from the group consisting of a circular form, a rectangular form and an elliptical form.

22. The electro-acoustic transducer according to claim 19, wherein said first and second magnets have a form selected from the group consisting of a cylindrical form, a rectangular parallelepiped form and an elliptical cylinder form.

23. The electro-acoustic transducer according to claim 19, wherein said drive coil has a form selected from the group consisting of a circular form, a rectangular form and an elliptical form.

24. The electro-acoustic transducer according to claim 19, wherein said drive coil is integrally formed with said diaphragm.

25. The electro-acoustic transducer according to claim 24, wherein said drive coil is deposited or printed on said diaphragm.

26. The electro-acoustic transducer according to claim 24, wherein said drive coil includes first and second drive coils, and said first and second drive coils are disposed on the upper surface and on the lower surface of said diaphragm, respectively.

27. The electro-acoustic transducer according to claim 25, wherein said diaphragm includes first and second diaphragms, and said drive coil is provided between said first and second diaphragms.

28. The electro-acoustic transducer according to claim 19, wherein said electro-acoustic transducer has a configuration that at least one sound hole is provided in at least one of upper and lower surfaces and sidewalls of said housing.

29. The electro-acoustic transducer according to claim 19, wherein an edge portion of said diaphragm has a form selected from the group consisting of a semicircular edge, an elliptical edge, a conical form edge, and a wave-form edge.

30. The electro-acoustic transducer comprising:

a diaphragm;

a housing comprising an upper case and a lower case and which supports a peripheral surface of said diaphragm within said upper and lower cases;

a first magnet disposed on said upper case so as to face a surface of said diaphragm;

a second magnet disposed on said lower case so as to face another surface of said diaphragm;

a drive coil which is provided in contact with said diaphragm so as to be coaxial with said first and second magnets and which is positioned between 1) a line defined parallel to a center axis of said drive coil which contacts a first portion of a peripheral surface of said first magnet and a first portion of a peripheral surface of said second magnet and 2) another line defined parallel to the center axis of said drive coil at an opposite side of said drive coil which contacts a second portion of the peripheral surface of said first magnet and a second portion of the peripheral surface of said second magnet;

a first yoke which forms a magnetic path in at least a portion of the periphery of said first magnet; and a second yoke which forms a magnetic path in at least a portion of the periphery of said second magnet, wherein said diaphragm is disposed between said first and second magnets; and said first and second magnets are each magnetized so that magnetic flux extends in a radial direction from a center axis passing through a center of said diaphragm.

31. The electro-acoustic transducer according to claim 30, wherein said first and second yokes are disposed outside of said first and second magnets relative to said diaphragm.

32. The electro-acoustic transducer according to claim 30, wherein said first and second yokes are provided on an outer surface and sidewalls of said magnets.

33. The electro-acoustic transducer according to claim 30, wherein said drive coil is of a rectangular form, said first and second magnets are of rectangular parallelepiped forms, and said first and second yokes are provided around outer peripheries obtained by extending at least two sides of each of said first and second magnets.

34. The electro-acoustic transducer according to claim 30, wherein air gaps are provided between said first yoke and outer peripheries of said first magnet and between said second yoke and outer peripheries of said second magnet.

35. The electro-acoustic transducer according to claim 30, wherein at least a portion of said housing includes said first and second yokes.

36. The electro-acoustic transducer according to claim 30, wherein said drive coil is provided inside of the outer periphery portions of said first and second yokes.

37. An electronic device comprising an electro-acoustic transducer, which comprises:

a diaphragm;

a housing comprising an upper case and a lower case and which supports a peripheral surface of said diaphragm within said upper and lower cases;

a first sole magnet disposed on said upper case so as to face a surface of said diaphragm;

a sole second magnet disposed on said lower case so as to face another surface of said diaphragm; and a drive coil which is provided in contact with said diaphragm so as to be coaxial with said first and second magnets and which is positioned so that a line parallel to a center axis of said drive coil which contacts a peripheral surface of one surface of said first magnet and a peripheral surface of said second magnet, passes through said drive coil, wherein said diaphragm is disposed between said first and second magnets; and said first and second magnets are magnetized in directions that are opposite to each other and so that magnetic flux extends through each of said first and second magnets in a direction parallel to a direction in which said diaphragm vibrates.

38. The electronic device according to claim 37, further comprising a housing, wherein said electro-acoustic transducer is attached to said housing.

39. An electronic device comprising an electro-acoustic transducer, which comprises:

a diaphragm;

a housing comprising an upper case and a lower case and which supports a peripheral surface of said diaphragm within said upper and lower cases;

a first magnet disposed on said upper case so as to face a surface of said diaphragm;

a second magnet disposed on said lower case so as to face another surface of said diaphragm; and a drive coil which is provided in contact with said diaphragm so as to be coaxial with said first and second magnets and which is positioned between 1) a line defined parallel to a center axis of said drive coil which contacts a first portion of a peripheral surface of said first magnet and a first portion of a peripheral surface of said second magnet and 2) another line defined parallel to the center axis of said drive coil at an opposite side of said drive coil which contacts a second portion of the peripheral surface of said first magnet and a second portion of the peripheral surface of said second magnet, wherein said diaphragm is disposed between said first and second magnets; and said first and second magnets are each magnetized in a radial direction from a center axis thereof, which also passes through a center of said diaphragm, to an outer periphery thereof so that magnetic flux extends from the center axis of said magnets to the outer periphery thereof.

40. The electronic device according to claim 39, further comprising a housing, wherein said electro-acoustic transducer is attached to said housing.

41. The electro-acoustic transducer comprising:

a diaphragm;

a housing comprising an upper case and a lower case and which supports a peripheral surface of said diaphragm within said upper and lower cases;

a first magnet disposed on said upper case so as to face a surface of said diaphragm;

a second magnet disposed on said lower case so as to face another surface of said diaphragm;

a drive coil which is provided in contact with said diaphragm so as to be coaxial with said first and second magnets and which is positioned between 1) a line defined parallel to a center axis of said drive coil which contacts a first portion of a peripheral surface of said first magnet and a first portion of a peripheral surface of said second magnet and 2) another line defined parallel to the center axis of said drive coil at an opposite side of said drive coil which contacts a second portion of the peripheral surface of said first magnet and a second portion of the peripheral surface of said second magnet;

a first yoke is provided in contact with an outer periphery of said first magnet and a second yoke is provided in contact with an outer periphery of said second magnet, wherein said diaphragm is disposed between said first and second magnets; and said first and second magnets are each magnetized so that magnetic flux extends in a radial direction from a center axis passing through a center of said diaphragm.

* * * * *